US008246152B2

(12) United States Patent
Kihara et al.

(10) Patent No.: US 8,246,152 B2
(45) Date of Patent: Aug. 21, 2012

(54) LIQUID DISCHARGE HEAD AND ITS MANUFACTURING METHOD

(75) Inventors: Hiroki Kihara, Sagamihara (JP); Akihiko Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 867 days.

(21) Appl. No.: 12/325,565

(22) Filed: Dec. 1, 2008

(65) Prior Publication Data

US 2009/0141085 A1 Jun. 4, 2009

(30) Foreign Application Priority Data

Dec. 3, 2007 (JP) ..... 2007-312455

(51) Int. Cl.
*B41J 2/175* (2006.01)

(52) U.S. Cl. ..... 347/87

(58) Field of Classification Search ..... 347/87
See application file for complete search history.

(56) References Cited

U.S. PATENT DOCUMENTS

| | | | |
|---|---|---|---|
| 5,013,383 | A | 5/1991 | Chapman |
| 2005/0078143 | A1 | 4/2005 | Shimomura et al. |
| 2007/0139467 | A1 | 6/2007 | Kihara et al. |
| 2008/0291234 | A1 | 11/2008 | Shimomura et al. |
| 2009/0066771 | A1 | 3/2009 | Mihara et al. |

FOREIGN PATENT DOCUMENTS

| | | | |
|---|---|---|---|
| JP | 2003-059643 | A | 2/2003 |
| JP | 2007-039681 | A | 2/2007 |

*Primary Examiner* — Jerry Rahll
(74) *Attorney, Agent, or Firm* — Fitzpatrick, Cella, Harper & Scinto

(57) ABSTRACT

A liquid discharge head comprises an element substrate made of Si having a discharge port for discharging a liquid, an energy generating element for generating an energy for allowing the liquid to be discharged from the discharge port, and a supply port for supplying the liquid to the discharge port and a liquid containing member made of a resin having a communication port communicated with the supply port, in which the element substrate and the liquid containing member are adhered with an adhesive agent. An inorganic film obtained by hardening compositions containing a silica precursor is formed on at least a surface corresponding to a portion of the liquid containing member to which the element substrate is adhered.

4 Claims, 5 Drawing Sheets

LIQUID DISCHARGE HEAD AND ITS MANUFACTURING METHOD

BACKGROUND OF THE INVENTION

1. Field of the Invention

The present invention relates to a liquid discharge head for discharging a liquid and, more particularly, to an ink jet recording head for recording by discharging ink onto a recording medium (medium to be recorded). The invention can be applied to: an apparatus for recording to a recording medium, that is, an apparatus such as printer, copying apparatus, facsimile apparatus having a communication system, word processor having a printer unit, or the like; and further, an industrial recording apparatus complexly combined with the various kinds of processing apparatuses.

2. Description of the Related Art

In the related art, a liquid discharge recording apparatus for recording by discharging recording liquid (ink) from discharge ports of a liquid discharge head has been known as a recording apparatus which is excellent in terms of low noises, high speed recording, and the like.

As a liquid discharge recording method, various methods have been proposed so far and there are a liquid discharge recording method which has been improved and put as a product on the market and a liquid discharge recording method to which a supreme effort for putting into practical use is being made.

For example, as illustrated in FIGS. 1A and 1B, such a kind of liquid discharge head is constructed by an element substrate 10 and a liquid containing member 70 made of a resin. The element substrate 10 has: an orifice plate 40 having discharge ports 30 for discharging the ink; a flow path 50 communicated with each discharge port 30; energy generating elements 20 each of which constructs a part of the flow path 50 and generates an energy for discharging; and a supply port 60 for supplying the liquid to each flow path 50. The liquid containing member 70 made of the resin has a communication port 80 communicated with each supply port 60.

In the head having such a construction as mentioned above, as disclosed in U.S. Pat. No. 5,013,383, there has been known such a technique that the element substrate 10 formed with the orifice plate 40 and the supply ports 60 is directly adhered to the liquid containing member 70 made of the resin by using a mounting adhesive agent 110. At this time, since a surface roughness of an element substrate adhering surface of the liquid containing member 70 made of the resin is not always good, generally, the surface is often thickly coated with the mounting adhesive agent. A thermosetting adhesive agent of a single liquid type which can be easily handled is used. After that, electric wiring members 130 are adhered to the liquid containing member 70 made of the resin and an electric connection is performed by the electric wiring members 130 and the element substrates 10. After that, an ambience of the element substrates 10 is sealed by an ambient sealing material 90. Further, an electric joint portion of the electric wiring member 130 and the element substrate 10 is sealed by a lead sealing material 100.

In the liquid discharge head with the above construction, since the thermosetting adhesive agent is used to adhere the element substrate made of Si and the liquid containing member made of the resin, it is necessary to heat. By the heating, both of the element substrate made of Si and the liquid containing member made of the resin are thermally expanded and they are adhered with the adhesive agent in such an expanding state. However, since there is a difference between a coefficient of linear expansion of the element substrate made of Si and that of the liquid containing member made of the resin, when a temperature of the liquid containing member made of the resin is returned to an ordinary temperature after completion of the thermosetting, the liquid containing member made of the resin is contracted larger than the element substrate made of Si.

Although such a large contraction of the liquid containing member made of the resin has not been considered as a serious problem so far, it will become a problem if the element substrate made of Si is further microfabricated in order to further reduce the costs in the future. For example, as illustrated in FIG. 2A, there is a case where a stress is caused in the element substrate made of Si by the contraction of the liquid containing member made of the resin and the element substrate made of Si is deformed in a an arch shape so that a length of edge portion and a length of center portion differ. Thus, as illustrated in FIG. 2B showing a cross sectional view of the center portion in FIG. 2A, there is a possibility that the discharge ports, supply ports, orifice plate, and the like are deformed and a defective discharge of the liquid occurs.

SUMMARY OF THE INVENTION

It is, therefore an object of the invention to provide a liquid discharge head comprising an element substrate made of Si having a discharge port for discharging a liquid, an energy generating element for generating an energy for allowing the liquid to be discharged from the discharge port, and a supply port for supplying the liquid to the discharge port and a liquid containing member made of a resin having a communication port communicated with the supply port, in which the element substrate and the liquid containing member are adhered with an adhesive agent, wherein an inorganic film obtained by hardening compositions containing a silica precursor is formed on at least a surface corresponding to a portion of the liquid containing member to which the element substrate is adhered.

Further features of the present invention will become apparent from the following description of exemplary embodiments with reference to the attached drawings.

BRIEF DESCRIPTION OF THE DRAWINGS

FIGS. 1A and 1B are schematic diagrams of a liquid discharge head, in which FIG. 1A illustrates a top view and FIG. 1B illustrates a schematic cross sectional view taken along the line IB-IB in FIG. 1A.

DESCRIPTION OF THE EMBODIMENTS

Figure 1A:
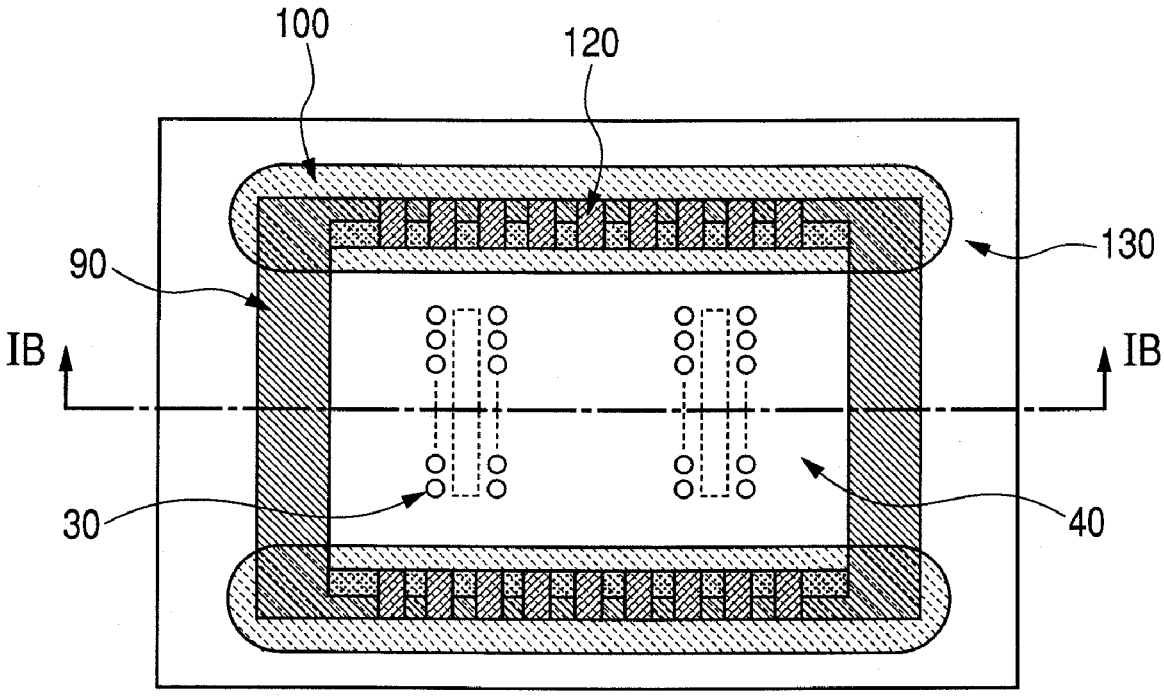
Figure 1B:
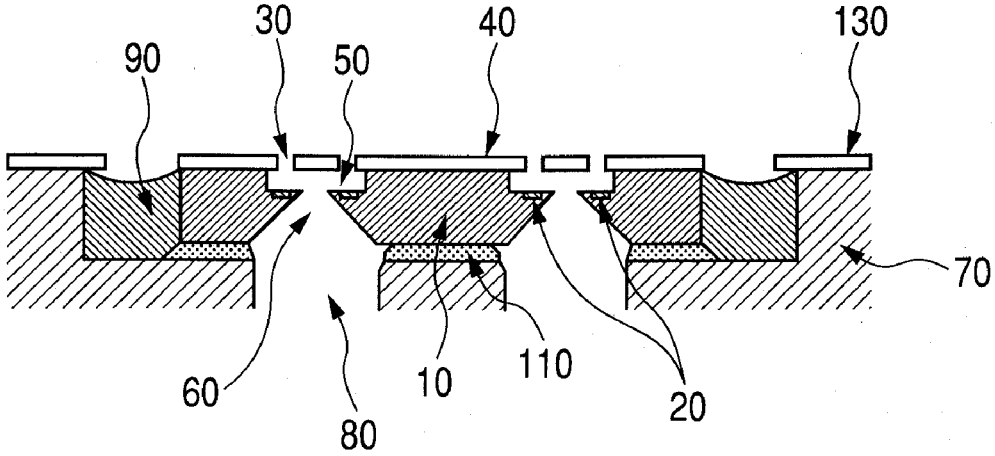
Figure 2A:
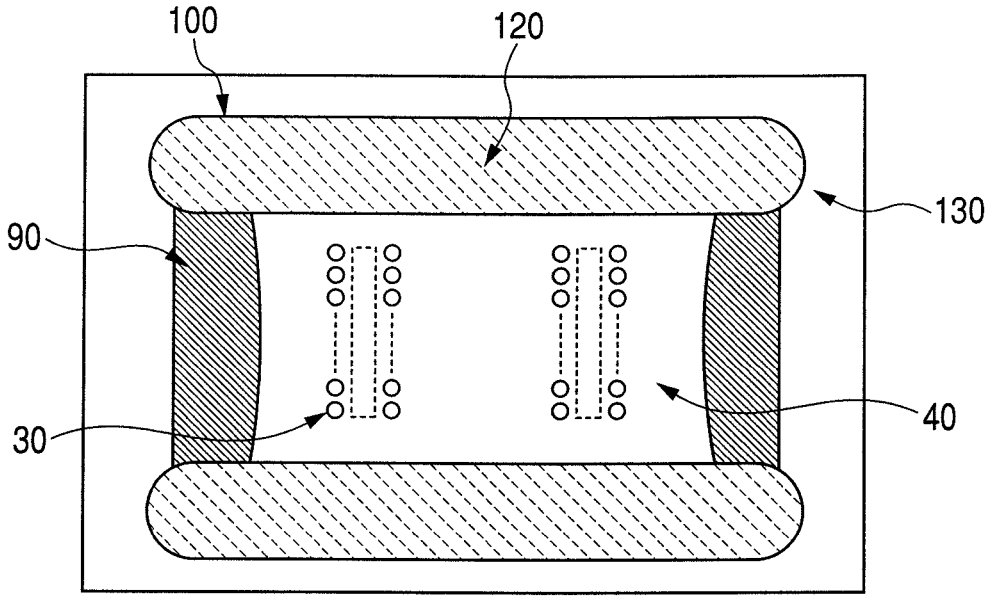
FIGS. 2A and 2B are schematic diagrams for describing a problem in the related art.
Figure 2B:
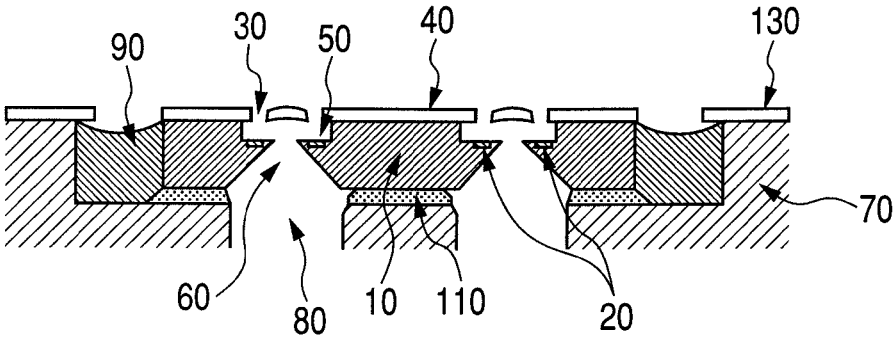

An exemplary embodiment of the invention will be described hereinbelow with reference to the drawings.

In the following description, component elements having substantially the same functions are designated by the same reference numerals in the diagrams and there is a case where their overlapped description is omitted.

A liquid discharge head can be mounted in: an apparatus such as printer, copying apparatus, facsimile apparatus having a communication system, word processor having a printer unit, and the like; and further, an industrial recording apparatus complexly combined with various kinds of processing apparatuses. By using the liquid discharge head, the recording can be performed to on various recording media such as paper, thread, fiber, silk or cotton cloth, leather, metal, plastics, glass, wood, and ceramics. It is assumed that the wording "record" which is used in the specification denotes not only a meaningful image such as character, figure, or the like is printed on the recording medium,, but also a meaningless image such as a pattern is printed on the recording medium.

Figure 3:
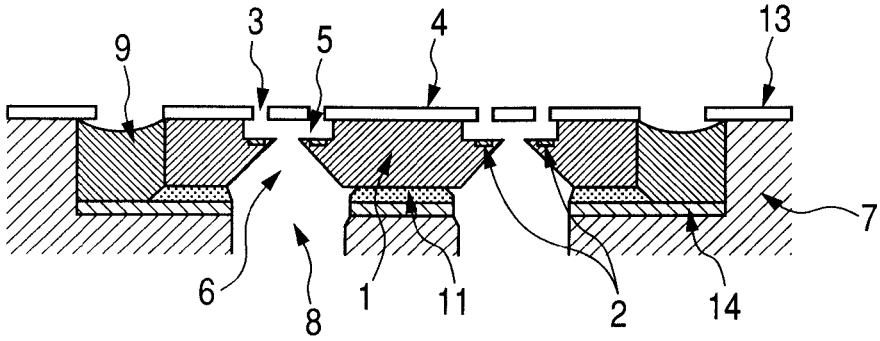
FIG. 3 is a schematic cross sectional view illustrating an example of the liquid discharge head according to the invention.
Figure 4:
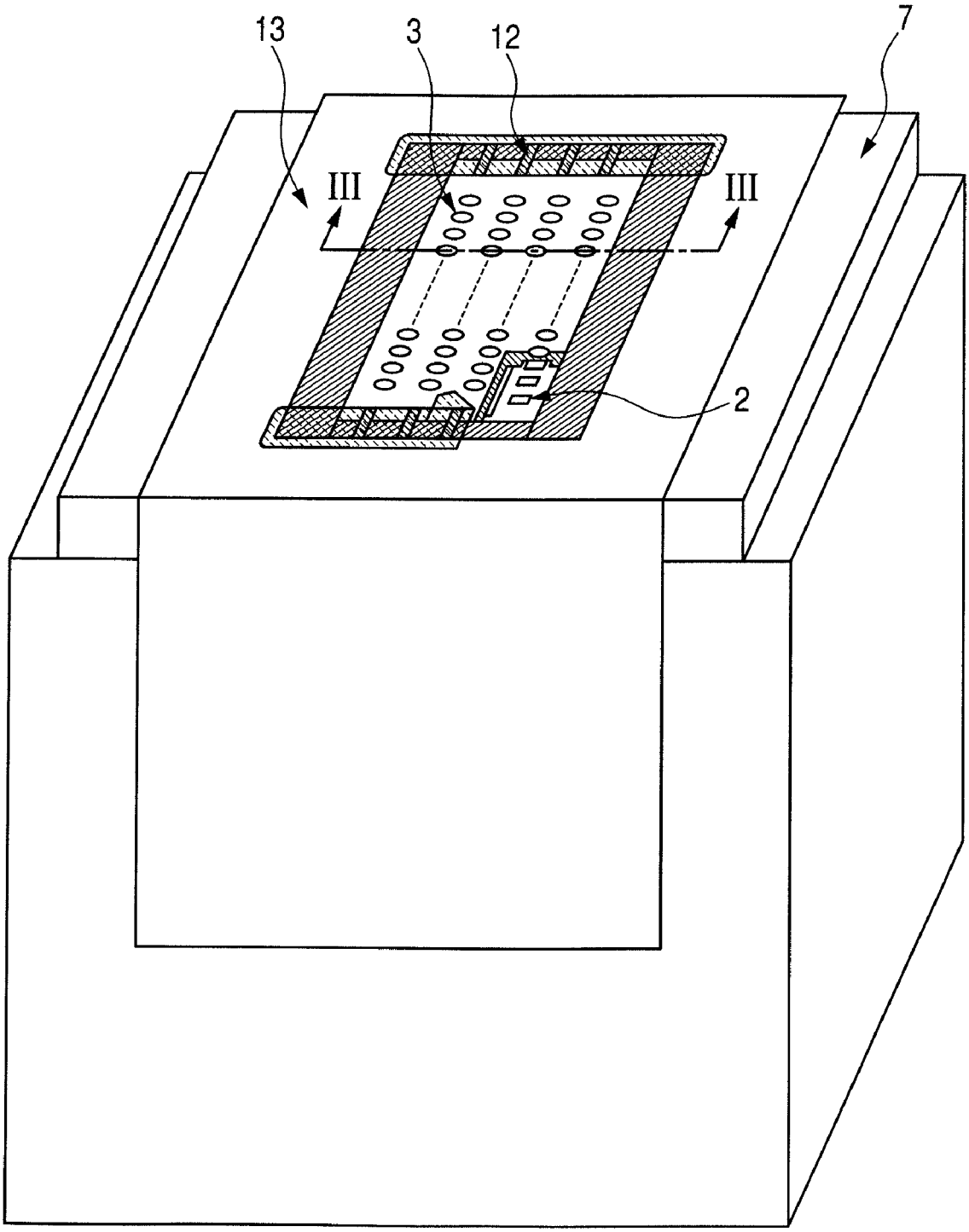
FIG. 4 is a perspective view illustrating an example of the liquid discharge head according to the invention.

FIG. 4 is a perspective view illustrating an example of the liquid discharge head according to the invention. A cross sectional view around an element substrate of the liquid discharge head according to an example of the invention is illustrated in FIG. 3. FIG. 3 is a diagram illustrating a cross section taken along the line III-III in FIG. 4.

As illustrated in FIGS. 3 and 4, the liquid discharge head is constructed mainly by an element substrate 1 made of Si and a liquid containing member 7 made of a resin as a liquid supplying member made of a resin. The element substrate 1 made of Si has: an orifice plate 4 having discharge ports 3 for discharging ink; a flow path 5 communicated with each discharge port 3; energy generating elements 2 each of which constructs a part of the flow path 5 and generates an energy for discharging; and a supply port 6 for supplying the liquid to each flow path 5. The liquid containing member 7 made of the resin as a liquid supplying member made of the resin has a communication port 8 communicated with each supply port 6 and is adhered to the element substrate 1 made of Si. An electric wiring member 13 for transferring a signal adapted to discharge the liquid to the element substrate 1 made of Si through a lead portion 12 is adhered onto the liquid containing member 7 made of the resin. There is an ambient sealing material 9 which is filled to an outer periphery of the element substrate 1 made of Si and into an outer peripheral area between the element substrate 1 and the liquid containing member 7 made of the resin. The lead portion 12 is sealed by a lead sealing material 18.

In the embodiment, the supply port 6 can be formed by, for example, an anisotropic etching technique. After the orifice plate 4 was coated with a material by, for example, a spin coating method or the like, shapes of the discharge port 3 and flow path 5 can be formed by using a photolithography technique. As a material of the orifice plate 4, for example, an epoxy resin and the like can be mentioned. However, the invention is not particularly limited to those materials. In the embodiment, a modified resin (heat deforming temperature of 120° C.) of polyphenylene ether (PPE), polystyrene (PS), and the like is used as a material of the liquid containing member 7 made of the resin. The liquid containing member 7 can be formed by, for example, an injection molding.

The liquid discharge head according to the invention has such a feature that the surface of the liquid supplying member made of the resin onto which at least the element substrate made of Si is adhered is coated with compositions containing a silica precursor as a surface treating agent and a hardened film (hereinbelow, referred to as an inorganic film) is formed. According to the inorganic film, since its coefficient of linear expansion is close to that of the element substrate made of Si, even if both of them are adhered with a thermosetting adhesive agent and heated and cooled, a large stress is not caused in the element substrate made of Si. Therefore, a deformation of the element substrate made of Si can be suppressed. As a liquid supplying member, besides a member in which only a path of the liquid to the element substrate is formed, a liquid containing member having such a structure that a containing portion such as a tank for containing the liquid and the foregoing path have been integrated can be also used.

As a silica precursor, polysilazane can be preferably used. A minute silica ($SiO_2$) film can be formed by reacting with oxygen or moisture in the air. Further, this reaction progresses by either of heating, maintaining moisture and keeping in normal temperature. However, in general, an excellent silica film can be obtained by heating. In case of the heating treatment, high temperature treatment at 450° C. and for one hour is required. However, curing at low temperature can be also obtained by adding the catalyst. If palladium catalyst is used, the curing temperature is lowered to approximately 250° C., and if amine catalyst is used, the curing temperature is lowered to approximately 100° C. The surface treating agent containing the silica precursor is compatibly soluble with the resin and high adhesion with the liquid containing member made of the resin is obtained owing to the existence of a polar group. Polysilazane has a structure shown by the following general formula.

Formula 1

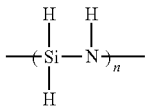

(1)

where, n indicates the repetition unit number.

The surface treating agent contains a solvent, a catalyst, and the like besides the silica precursor. As a solvent, it is not particularly limited but any solvent can be used so long as it can dissolve the silica precursor and has proper volatility to a certain extent in which the surface can be coated with the solvent by a thin film coating method. For example, xylene, solvesso and dibutyl ether can be used as solvent. Xylene is preferable since it is excellent to disssolve the silica and the desity of approximately 20% can be obtained so that time for obtaining a desired thickness of the silica can be shortened. Such a surface treating agent is generally commercially available as an agent for forming a Spin-On Glass (SOG) film in the semiconductor field or a silica surface coating material of an automobile exterior and can be easily obtained.

As a manufacturing method of the liquid discharge head according to the invention, the surface of the liquid containing member made of the resin onto which the element substrate made of Si is adhered is coated with the surface treating agent and the surface treating agent is hardened at a temperature which is equal to or lower than the heat deforming temperature of the liquid containing member made of the resin, thereby forming the inorganic film. As a coating method, a transfer by a transfer print, a spray coating, or the like can be used. Subsequently, the liquid containing member made of the resin is adhered to the element substrate made of Si by using the thermosetting adhesive agent as a mounting adhesive agent and the thermosetting adhesive agent is heated and hardened.

Although a film thickness after the surface treating agent was hardened is not particularly limited, in the case of the surface treating agent containing polysilazane, it is desirable to set the film thickness to a value within a range from 0.5 μm or more to less than 2 μm. This is because although it is also considered that if the inorganic film is thickened, the stress which is applied to the element substrate made of Si can be reduced, if the film thickness is set to 2 μm or more, there is a case where a cracking occurs depending on the coating condition.

As a material of the liquid containing member made of the resin, any material can be used so long as it is a resin material having ink resistance properties. For example, the modified resin (modified PPE) of polyphenylene ether (PPE), polystyrene (PS), and the like can be desirably used because it has the ink resistance properties, the molding is easy, and it is relatively reasonable. The heat deforming temperature of the modified PPE is equal to about 120° C.

As a thermosetting adhesive agent, an agent which is hardened and adhered by the heating after the coating is used. Although it is not particularly limited, a single-liquid thermosetting adhesive agent is desirably used for performance. A thickness of adhesive agent is set to such a thickness that it is not influenced by the surface roughness of the element substrate adhering surface. Although it is not particularly limited, it is desirable to set the thickness to a value within a range from 20 μm or more to less than 200 μm.

The invention will be described in detail hereinbelow with respect to Examples and Comparative example with reference to FIGS. 5A to 5D. FIGS. 5A to 5D are cross sectional views similar to FIG. 3. The invention is not limited to following Examples.

EXAMPLE 1

First, the liquid containing member 7 made of the resin is prepared.

Figure 5A:
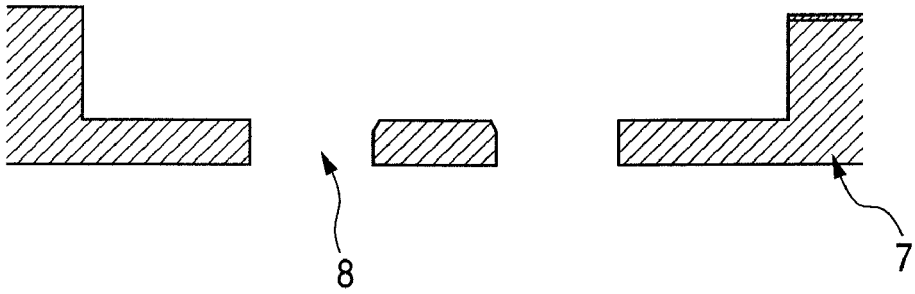
FIGS. 5A, 5B, 5C and 5D are schematic cross sectional views illustrating an example of a manufacturing method of the liquid discharge head according to the invention.
Figure 5B:
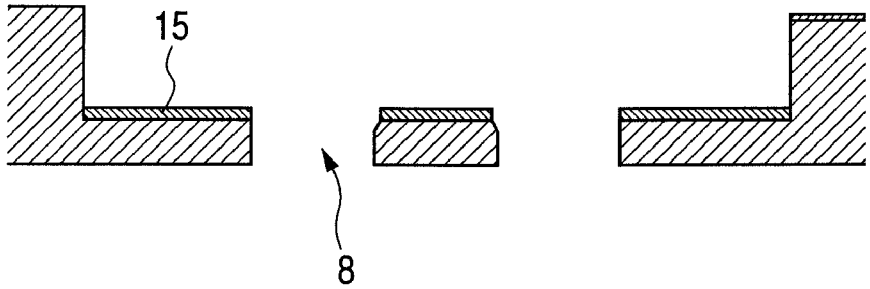

Subsequently, the communication port 8 is an opened surface. The surface of the communication port 8 corresponding to a position where the element substrate 1 made of Si is adhered is coated with a surface treating agent (trademark: NP110-20 (catalyst: amine series, solvent: xylene and density 20%) made by AZ Electronic Materials Co., Ltd.) as a surface treating agent containing polysilazane (FIG. 5B).

Figure 5C:
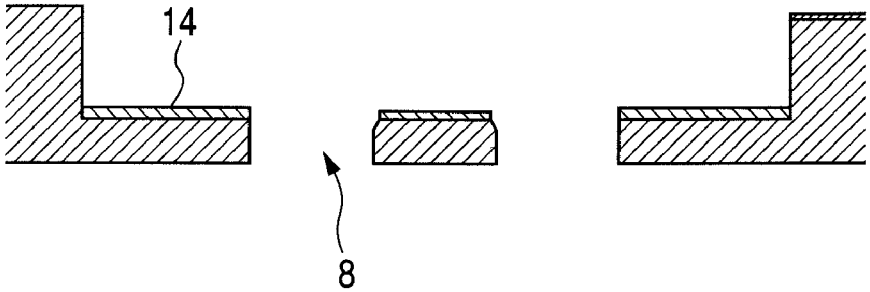

Subsequently, the surface treating agent is hardened at 100° C. for three hours and an inorganic film 14 containing $SiO_2$ is formed so as to have a thickness of 0.5 μm (FIG. 5C).

Figure 5D:
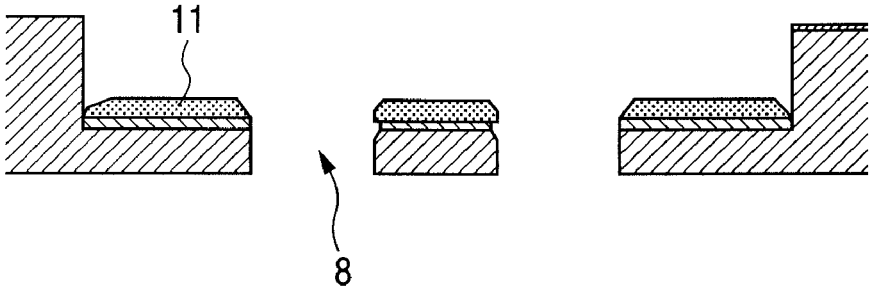

Further, the upper surface of the inorganic film 14 is coated with a mounting adhesive agent 11 (single-liquid thermosetting adhesive agent) made of an epoxy resin and an amine-series hardening agent (FIG. 5D)

Subsequently, the element substrate 1 made of Si is positioned and mounted onto the adhesive agent and hardened at 100° C. for one hour. The electric wiring members 130 are connected to the element substrate 1 and a necessary sealing process is executed, thereby manufacturing the liquid discharge head in the state as illustrated in FIG. 3.

EXAMPLE 2

The liquid discharge head is manufactured in a manner similar to that of Example 1 except that the thickness of inorganic film 14 is set to 1.1 μm.

COMPARATIVE EXAMPLE 1

The liquid discharge head is manufactured in a manner similar to that of Example 1 except that the adhering surface of the liquid containing member made of the resin is not coated with the surface treating agent containing polysilazane in Example 1.

(Evaluation)

Figure 6:
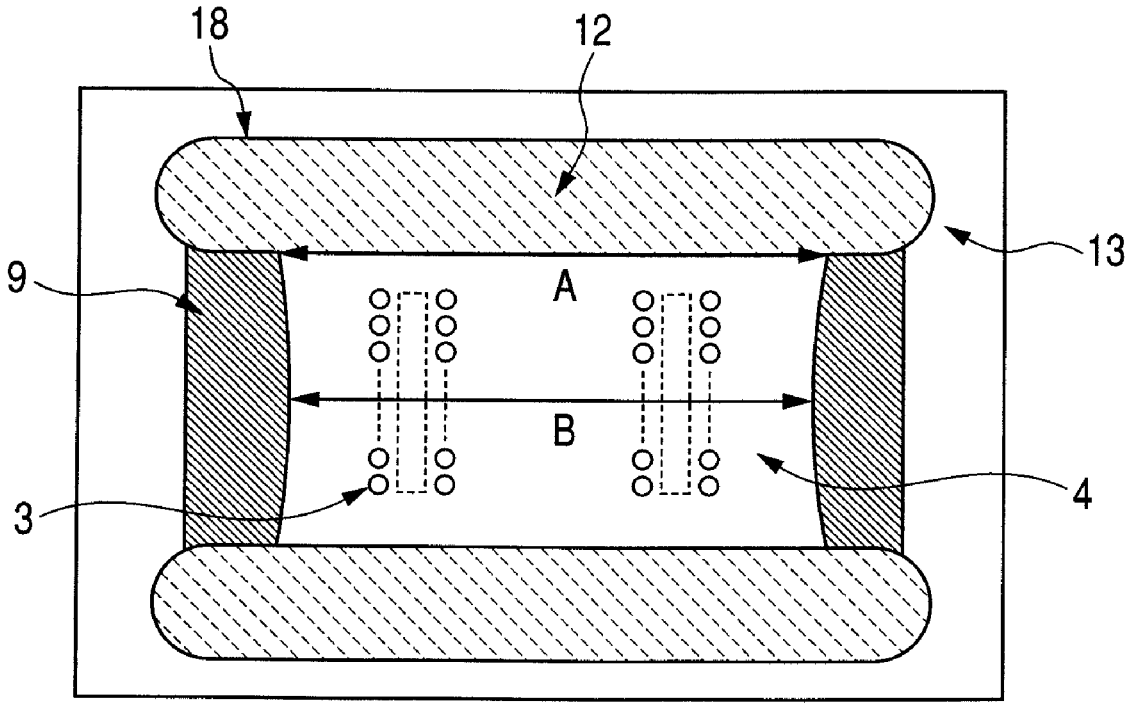
FIG. 6 is a plan view of the liquid discharge head when seen from the top side.

Deformation amounts of the element substrates made of Si in the three kinds of liquid discharge heads manufactured in Examples 1 and 2 and Comparative example 1 are evaluated. Evaluation results are shown in Table 1. Each of the deformation amounts is obtained by measuring a length by using a microscope. That is, as illustrated in FIG. 6 showing the liquid discharge head when seen from the discharge port side, the deformation amount is obtained from a difference between a length A in an edge portion of the element substrate made of Si and a length B in a center portion. As dimensions of the element substrate made of Si, the length A is equal to 5 mm and a length of side which is perpendicular to A is equal to 11 mm.

$A-B<2$ μm X

2 μm$\leqq A-B<3$ μm Y

3 μm$\leqq A-B$ Z

In the liquid discharge head of Comparative example, the deformation amount of the element substrate made of Si is large. However, in Examples, as the film thickness of polysilazane increases, the deformation amount of the element substrate made of Si decreases. However, when the film thickness of polysilazane is larger than 2 μm, a crack occurs in the polysilazane film. From the above points, it can be said that it is desirable that the film thickness of inorganic film 14 containing polysilazane lies within a range from 1.1 μm or more to 2 μm or less.

TABLE 1

| | Film thickness of surface-treated film (μm) | Evaluation |
|---|---|---|
| Example 1 | 0.5 | Y |
| Example 2 | 1.1 | X |
| Comparative example 1 | 0 (no finishing process) | Z |

Subsequently, the above three kinds of liquid discharge heads are filled with ink made of pure water, glycerin, and direct black 154 (water soluble black dye) at a mixture ratio of (65:30:5) and the recording is executed. Although the good printing can be executed by the liquid discharge heads of Examples, in the liquid discharge head of Comparative example 1, a defective printing which seems to be caused by a wrinkle of discharge liquid droplets appears very rarely.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-312455, filed Dec. 3, 2007, which is hereby incorporated by reference herein in its entirety.

What is claimed is:

1. A liquid discharge head comprising:

an element substrate made of Si and having a discharge port for discharging a liquid, an energy generating element for generating energy for discharging the liquid from the discharge port, and a supply port for supplying the liquid to the discharge port; and a liquid containing member made of a resin and having a communication port communicating with the supply port, the element substrate and the liquid containing member being adhered with an adhesive agent, wherein an inorganic film obtained by hardening compositions containing a silica precursor is formed on at least a surface corresponding to a portion of the liquid containing member to which the element substrate is adhered.

2. A head according to claim 1, wherein the silica precursor is polysilazane and the inorganic film contains $SiO_2$.

3. A head according to claim 2, wherein a thickness of the inorganic film lies within a range from 1.1 μm or more to 2 μm or less.

4. A head according to claim 1, wherein the liquid containing member comprises a modified resin formed from polyphenylene ether and polystyrene.

* * * * *